US006131762A

United States Patent [19]

Metcalfe

[11] Patent Number: 6,131,762

[45] Date of Patent: Oct. 17, 2000

[54] REINFORCING MEMBER FOR CONTAINERS

[75] Inventor: William Mervyn Metcalfe, Mona Vale, Australia

[73] Assignee: Cyplex Pty Limited, Warriewood, Australia

[21] Appl. No.: 09/245,945

[22] Filed: Feb. 5, 1999

[30] Foreign Application Priority Data

Feb. 6, 1998 [AU] Australia ..... PP1661

[51] Int. Cl.[7] ..... B65D 6/34

[52] U.S. Cl. ..... 220/651; 217/65; 220/652; 220/678; 403/231

[58] Field of Search ..... 217/5, 6, 65, 40, 217/17; 206/453; 220/639, 643, 651, 652, 653, 678, 680; 403/217, 219, 265, 266, 270, 272, 269, 231, 401, 402, 334

[56] References Cited

U.S. PATENT DOCUMENTS

| | | | |
|---|---|---|---|
| 476,121 | 5/1892 | Baker | 217/5 |
| 503,976 | 8/1893 | Mengel | 217/5 |
| 1,283,079 | 10/1918 | Cocrane | 217/65 X |
| 3,370,871 | 2/1968 | Piarotto | 403/219 |
| 4,421,366 | 12/1983 | Niziol . | |
| 4,833,761 | 5/1989 | Geldwerth | 24/616 |
| 5,820,718 | 10/1998 | Dean | 156/211 |
| 5,848,852 | 12/1998 | Shpigel | 403/219 |
| 5,896,866 | 4/1999 | Quennessen | 132/293 |

FOREIGN PATENT DOCUMENTS

| | | | |
|---|---|---|---|
| 381407 | 1/1922 | Germany | 217/40 |
| 301649 | 12/1928 | United Kingdom | 217/5 |
| 455869 | 10/1936 | United Kingdom | 217/5 |
| 1 276 795 | 7/1972 | United Kingdom . | |

*Primary Examiner*—Allan N. Shoap
*Assistant Examiner*—Joe Merek
*Attorney, Agent, or Firm*—David P. Gordon; David S. Jocoboson; Thomas A. Gallagher

[57] ABSTRACT

A reinforcing block (15) adapted to fit closely into and extend along the joint (10) between the floor (12) and wall panel (14) of a container of the type commonly used for bulk food storage and display in supermarkets. The block (15) has an underside surface (16) and rear surface (18) for abutting, respectively, the floor (12) and wall panel (14). The exposed surface (20) of the block extends at approximately 45° between the underside and rear surface forming an obtuse angle with both the wall and floor surfaces. The end portions (24, 24') of the block taper into the joint (10) so that their exposed surfaces form an obtuse angle with the joint. This arrangement enables easy cleaning of the container.

11 Claims, 2 Drawing Sheets

REINFORCING MEMBER FOR CONTAINERS

BACKGROUND OF THE INVENTION

1. Field of the Invention

The present invention relates to a reinforcing block for use in the construction of containers of the type commonly used for bulk food storage and display in supermarkets. The invention also relates to containers including the reinforcing blocks and to a method of construction of the containers.

2. State of the Art

Such containers are typically manufactured by gluing of relatively rigid plastic sheet material, usually acrylic (PMMA) because of its combination of toughness and transparency. The containers are often box-like and thus the junctions between two or more sheets are usually orthogonal. These junctions are butt joined and glued using a short length of square or triangular acrylic section as a reinforcing block. The blocks are cut to length from a constant-section extruded length of acrylic, using a docking saw.

This prior art arrangement provides a convenient method of construction, but is difficult to clean thoroughly as food waste and dirt tends to become clogged in the end of the block and its junction with the acrylic sheets. The present invention aims to provide a more hygienic arrangement.

SUMMARY OF THE INVENTION

The invention provides a reinforcing block for reinforcing a junction between two or more panels of a container, the block having a first surface abutting a first of said panels, a second surface abutting a second of said panels and an exposed surface extending between the first and second surfaces, the exposed surface having at least one portion which tapers into the junction between the first and second panels so as to form an obtuse angle with the junction.

Preferably, the block is elongate and has a longest edge coinciding with the junction. Preferably the tapered portion is at an end of the elongate block.

Desirably, the first and second surfaces are substantially orthogonal, the block being substantially a right angled triangle in transverse cross-section, preferably a right-angled isosceles triangle, Preferably, the end portion is also triangular in transverse cross-section.

Further preferred embodiments will now be described with reference to the accompanying drawings:

DETAILED DESCRIPTION OF THE PREFERRED EMBODIMENTS

Figure 1:
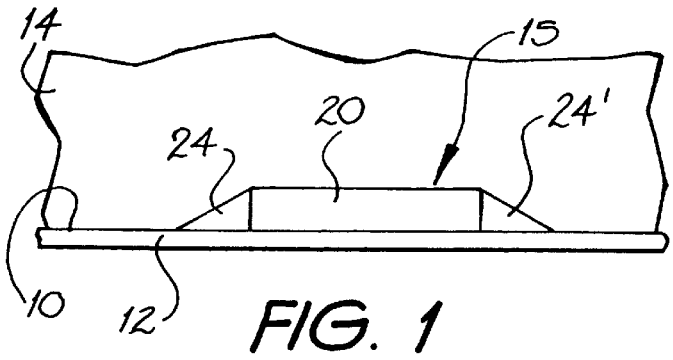
FIGS. 1 to 4 are, respectively, front, plan, left hand end and schematic perspective views of a first preferred reinforcing block type used at the junction between two acrylic panels.
Figure 3:
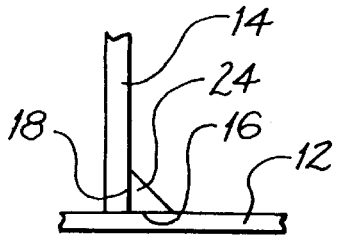
Figure 2:
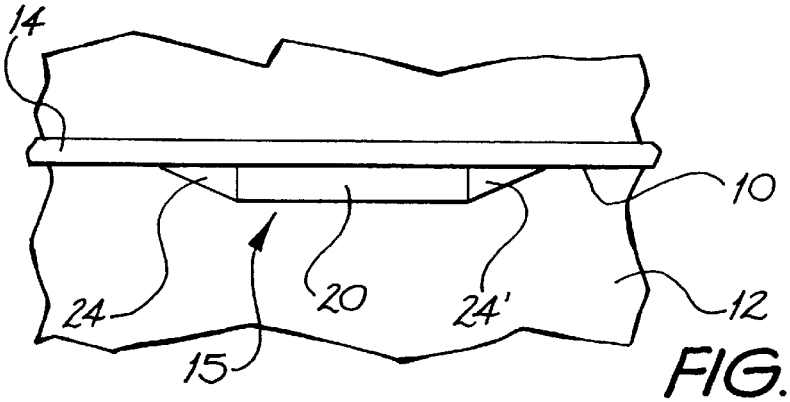
Figure 4:
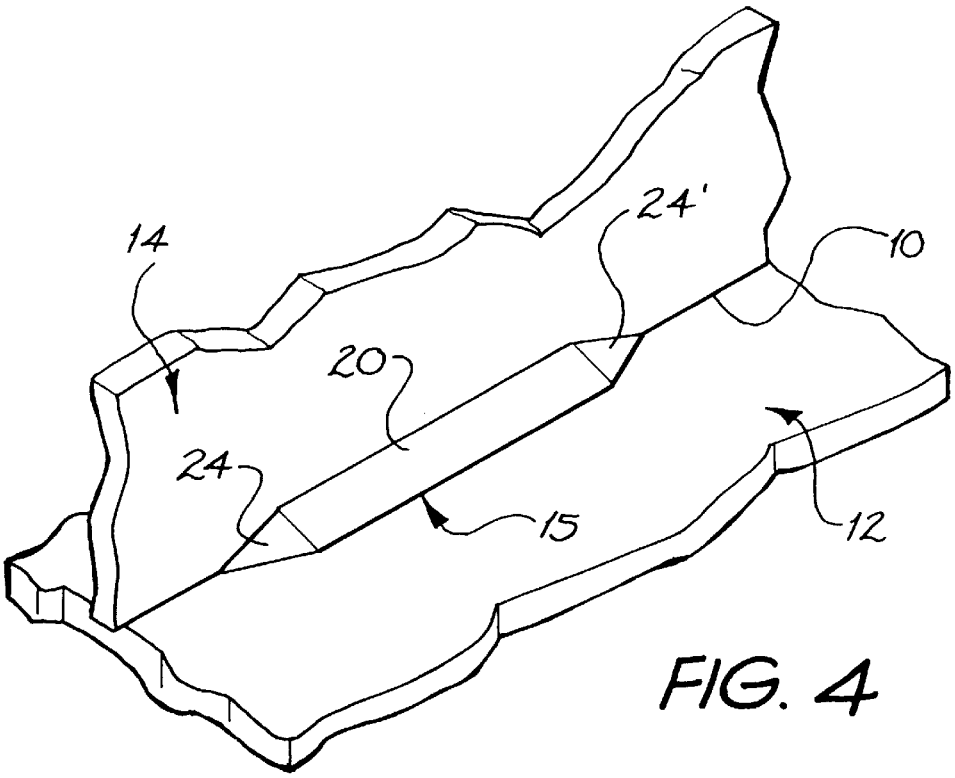

FIGS. 1 to 4 illustrate the joint 10 between a floor 12 and a wall panel 14 of 3 to 10 mm thick PMMA or similar material, in accordance with a first embodiment.

An elongate PMMA reinforcing block 15 is adapted to fit closely into and extend along the joint 10, having an underside surface 16 and rear surface 18 for abutting, respectively, the floor 12 and wall panel 14. The exposed surface 20 of the main central portion of the block extends at approximately 45° between the underside and rear surfaces forming an obtuse angle with both the wall and floor surfaces. The end portions 24, 24' of the block taper into the joint 10 so that their exposed surfaces form an obtuse angle with the joint, preferably about 110°–160°, most preferably about 120°–160°.

The reinforcing block is preferably formed by moulding, such as injection moulding, to ensure that the exposed surfaces of the block are smooth, to facilitate cleaning compared to the rough end which results form a docking saw, To adhere the PMMA panels and reinforcing block together, solvent adhesives of the type well known in acrylic fabrication may be used. A small amount of the solvent adhesive may be applied, for example by a dropper or syringe, to the junction of the block and the panels, the solvent travelling by capillary action to coat the abutting surfaces and adhere within about 30 seconds.

Figure 5:
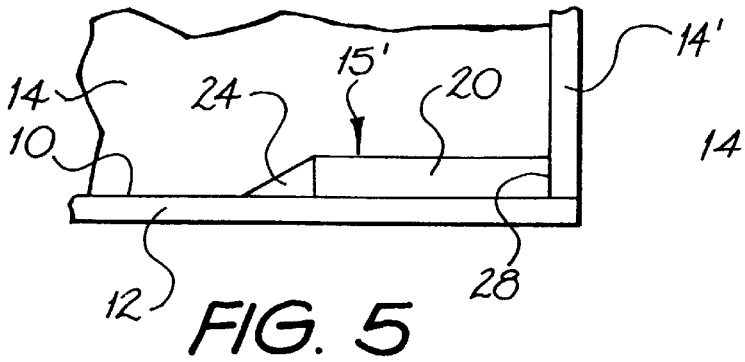
FIGS. 5 to 8 are similar views of a second preferred reinforcing block type used at the junction of three acrylic panels.
Figure 7:
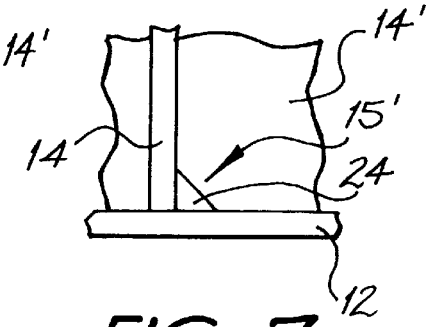
Figure 6:
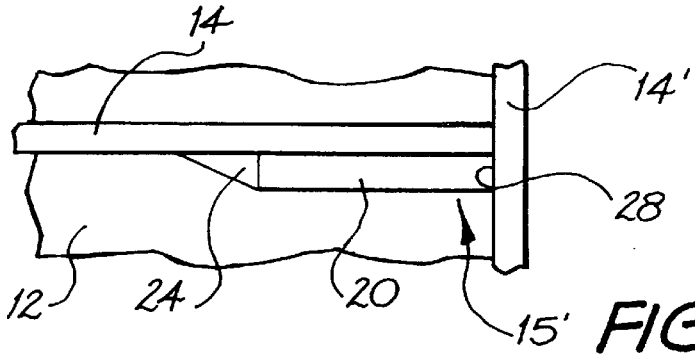
Figure 8:
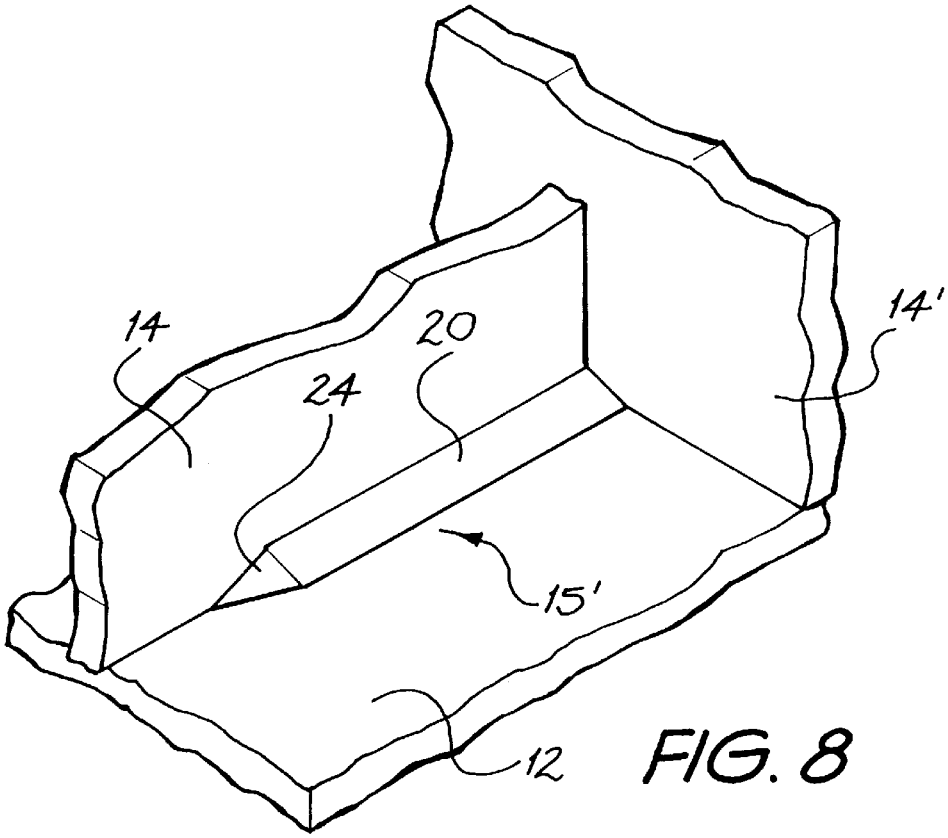

FIGS. 5 to 8 show an orthogonal comer junction between a floor and two wall panels of a container. The components are generally similar to that of FIGS. 1 to 4, and like reference numerals are used to denote like parts.

The reinforcing block 15' of FIGS. 5 to 8 differs from that of the first embodiment in that one tapered end 24' of the block is absent, the block instead having a squared-off end surface 28 which abuts the respective wall panel 14'.

While particular embodiments of this invention have been described, it will be evident to those skilled in the art that the present invention may be embodied in other specific forms without departing from the essential characteristics thereof The present embodiments and examples are therefore to be considered in all respects as illustrative and not restrictive, and all modifications which would be obvious to those skilled in the art are therefore intended to be embraced therein.

I claim:

1. A container having a junction between at least two panels and a solid reinforcing block which reinforces said junction, the block having a first surface adhered to a first of said panels, a second surface adhered to a second of said panels and an exposed surface extending between the first and second surfaces, the exposed surface having at least one portion which tapers into the junction between the first and second panels so as to form an obtuse angle with the junction and wherein the block has its sole longest edge coinciding with the junction.

2. The container of claim 1 wherein the tapered portion is at an end of the elongate block.

3. The container of claim 1 wherein the first and second surfaces of the block are substantially orthogonal, the block being substantially a right angled triangle in transverse cross-section.

4. The container of claim 3 wherein the right angled triangle is an isosceles triangle.

5. The container of claim 2 wherein the end portion of the block is also triangular in transverse cross-section.

6. The container of claim 1 wherein the block is formed of rigid plastics material.

7. The container of claim 6 wherein the block is formed of acrylic PMMA.

8. The container of claim 1 wherein the panels are connected at orthogonal junctions wherein at least one of said junctions has a said block adhered thereto.

9. A container having a junction between at least two panels and a solid reinforcing block which reinforces said junction, the block having a first surface adhered to a first of said panels, a second surface adhered to a second of said panels and an exposed surface extending between the first and second surfaces, the exposed surface having two portions which taper into the junction between the first and second panels so as to each form an obtuse angle with the junction, the two portions being mutually non-parallel.

10. A container according to claim 9, wherein said block has a length along said junction and a height perpendicular to said junction, and said length is at least several times longer than said height.

11. A container having at least two panels defining a junction therebetween and a solid, elongate reinforcing block which reinforces said junction, the block having a height perpendicular to said junction, a length along said junction with said length being at least several times longer than said height, a first surface adhered to a first of said panels, a second surface adhered to a second of said panels and, an exposed surface extending between the first and second surfaces, the exposed surface having at least one portion which tapers into the junction between the first and second panels so as to form an obtuse angle with the junction and wherein the block has its sole longest edge coinciding with the junction.

* * * * *